US011614213B2

(12) United States Patent
Sieber et al.

(10) Patent No.: US 11,614,213 B2
(45) Date of Patent: Mar. 28, 2023

(54) PROJECTION ASSEMBLY FOR A MOTOR VEHICLE HEADLIGHT

(71) Applicant: ZKW Group GmbH, Wieselburg (AT)

(72) Inventors: Lukas Sieber, Pöchlarn (AT); Clemens Hauer, Steinakirchen am Forst (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 17/435,836

(22) PCT Filed: Feb. 13, 2020

(86) PCT No.: PCT/EP2020/053749
§ 371 (c)(1),
(2) Date: Sep. 2, 2021

(87) PCT Pub. No.: WO2020/193002
PCT Pub. Date: Oct. 1, 2020

(65) Prior Publication Data

US 2022/0154904 A1 May 19, 2022

(30) Foreign Application Priority Data

Mar. 22, 2019 (EP) ..... 19164605

(51) Int. Cl.
*F21S 41/25* (2018.01)
*F21S 41/29* (2018.01)
(Continued)

(52) U.S. Cl.
CPC ..... *F21S 41/29* (2018.01); *F21S 41/255* (2018.01); *F21S 41/43* (2018.01); *F21S 41/47* (2018.01); *F21S 45/47* (2018.01)

(58) Field of Classification Search
CPC .. F21S 41/40; F21S 41/68; F21S 41/47; F21S 41/29; F21W 2102/00; F21W 2102/18;
(Continued)

(56) References Cited

U.S. PATENT DOCUMENTS

2013/0107564 A1* 5/2013 Yatsu ..... F21S 41/338 362/543
2014/0112013 A1* 4/2014 Okawa ..... F21V 13/02 362/516
2014/0355286 A1* 12/2014 Arita ..... F21S 41/36 362/516

FOREIGN PATENT DOCUMENTS

AT 504793 A4 8/2008
EP 1764549 A1 3/2007
(Continued)

OTHER PUBLICATIONS

International Search Report for PCT/EP2020/053749 dated May 14, 2020 (6 pages).
(Continued)

*Primary Examiner* — Omar Rojas Cadima
(74) *Attorney, Agent, or Firm* — Eversheds Sutherland (US) LLP

(57) ABSTRACT

Projection device (10) for a motor vehicle headlight, which projection device (10) comprises the following:
projection optics (50),
a shield element (100),
a base body (200),
wherein the shield element (100) can be pushed onto the base body (200) along a push-on direction (X) by means of guide elements (110) onto the base body (200), wherein the guide elements (110) engage in counter-guide elements (210),
and wherein the guide elements (110) have an end stop (111) and the counter-guide elements (210) have a stop (211), which stops (211) are designed in combination with the end stops (111) to limit the movement of the shield element (100) in the direction of the push-on direction (X) towards an end position, wherein the projection device (10) comprises at least one clamping device, which com-
(Continued)

Figure 1:
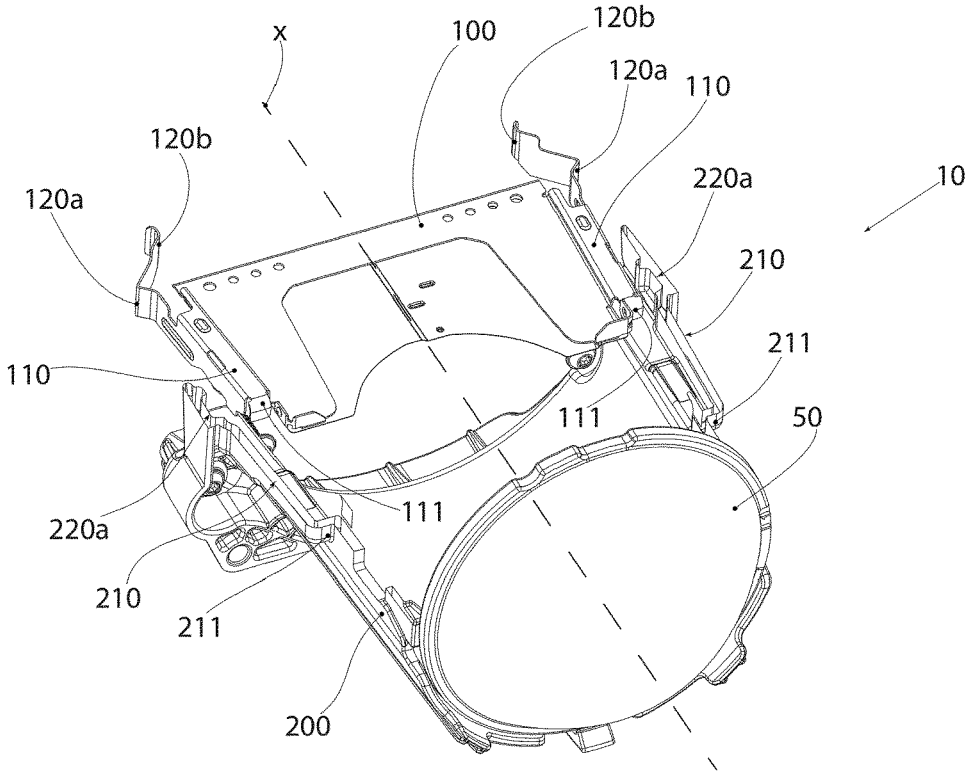

prises a first and a second clamping element (120*a*, 220*a*), wherein the first clamping element (120*a*) is designed to engage the second clamping element (220*a*), and wherein the at least one clamping device is designed to clamp the shield element (100) in its end position on the base body (200).

16 Claims, 4 Drawing Sheets

(51) Int. Cl.

| | |
|---|---|
| ***F21S 41/47*** | (2018.01) |
| ***F21S 41/255*** | (2018.01) |
| ***F21S 41/43*** | (2018.01) |
| *F21S 45/47* | (2018.01) |

(58) Field of Classification Search
CPC ..... F21W 2102/13; F21W 2105/00; F21V 17/104; F21V 17/107; F21V 17/108; F21V 17/164; F21V 17/166; F21V 17/168
See application file for complete search history.

(56) References Cited

FOREIGN PATENT DOCUMENTS

| | | | |
|---|---|---|---|
| EP | 2527726 | A2 | 11/2012 |
| EP | 3196542 | A1 | 7/2017 |
| EP | 3404314 | A1 | 11/2018 |
| JP | 2006040839 | A | 2/2006 |
| WO | 2015176340 | A1 | 11/2015 |

OTHER PUBLICATIONS

Search Report for European Patent Application No. 19164605.8 dated Sep. 6, 2019 (8 pages).

* cited by examiner

PROJECTION ASSEMBLY FOR A MOTOR VEHICLE HEADLIGHT

The invention relates to a projection device for a motor vehicle headlight, which projection device comprises the following:

projection optics for imaging a light distribution, which is formed from light emitted from at least one light source, a shield element, a base body, wherein the projection optics and the shield element are mechanically connected to the base body, wherein the shield element can be pushed onto the base body along a push-on direction by means of at least two, preferably precisely two guide elements onto the base body, wherein the guide elements engage in counter-guide elements arranged on the base body and corresponding to the guide elements, and wherein the guide elements of the shield element respectively have an end stop at a first end and the counter-guide elements of the base body respectively have a stop, which stops are designed in combination with the end stops of the guide elements to limit the movement of the shield element in the direction of the push-on direction towards an end position.

Furthermore, the invention relates to a motor vehicle headlight having at least one projection device according to the invention.

A shield element in a projection device or an illumination device of a motor vehicle headlight serves to form a shading of a light distribution that can be generated by a light source, for example for producing a cut-off line.

Such shading serves, for example, to avoid being dazzled by oncoming traffic or to comply with legal requirements for appropriate light distribution. In this case, it is desirable to arrange the shield element on the base body in such a way that it is attached with as little play as possible. In particular, in the case of vibrations of the headlight when the vehicle is in operation, the shield element must be prevented from performing an oscillating movement in its arrangement on the base body or from permanently altering its position.

The position of the shield element, in particular the horizontal alignment, is vitally important for desired light functions. In this case, the arrangement of the shield element on the base body should, however, be enabled without further connection means as far as possible in order to simplify the structural design of the light module.

It is an object of the invention to provide an improved projection device.

This object is achieved by means of the fact that the projection device comprises at least one clamping device, which comprises a first and a second clamping element, wherein the first clamping element is arranged on the shield element and the second clamping element is arranged on the base body, and wherein the first clamping element is designed to engage the second clamping element, and wherein the at least one clamping device is designed to clamp the shield element in its end position on the base body.

It can be provided that the projection optics are designed as a projection lens.

It can advantageously be provided that the projection device comprises a holding element and at least one securing device, which at least one securing device comprises a first and a second securing element, wherein the first securing element is designed to engage the second securing element, and wherein the at least one securing device is designed to secure the at least one clamping device against disengagement of the clamping elements, wherein the first securing element is arranged on the shield element and the second securing element is arranged on the holding element.

In order to disengage the clamping elements of the clamping device, a force is, in principle, required in a certain direction, which must be applied, wherein the securing device opposes and counteracts this force direction.

It can be provided that the holding element of the projection optics is attached to the base body opposite along the push-on direction.

In one practical embodiment of the invention, the guide elements of the shield element can be arranged on the shield element spaced apart from one another orthogonally to the push-on direction It can advantageously be provided that at least two, preferably precisely two clamping devices are provided, wherein a first clamping element is assigned to each guide element of the shield element.

It can be provided that the first clamping element of the clamping devices is respectively arranged at a second end opposite the first end of the guide elements.

It can be favorable if the first clamping element is designed as a latching element, preferably as a latching lug, and the second clamping element is designed as a mating latching element, preferably as an undercut or recess.

It can be provided that the second securing element of the holding element is designed as a pin projecting from the holding element in the direction of the push-on direction.

It can advantageously be provided that the at least one securing device is designed in such a manner that the second securing element in engagement with the first securing element exerts a force transverse to the push-on direction on the first securing element.

It can be provided that the first clamping element of the at least one clamping device is formed with the first securing element of the at least one securing device as an integral, elastic spring tongue.

It can furthermore be favorable if the spring tongue is connected integrally with the at least one guide element of the shield element.

It can be favorable if the shield element is arranged in a notional horizontal plane in the projection device.

It can be provided that the illumination device comprises at least one light source, which is designed to emit light in a main emission direction.

It can be favorable if the push-on direction is parallel to the main emission direction.

It can be provided that the holding element is designed as a heat sink which is assigned to the at least one light source and is designed to dissipate the heat generated by the at least one light source.

The object is also achieved with a motor vehicle headlight, which comprises at least one projection device according to the invention.

Figure 2:
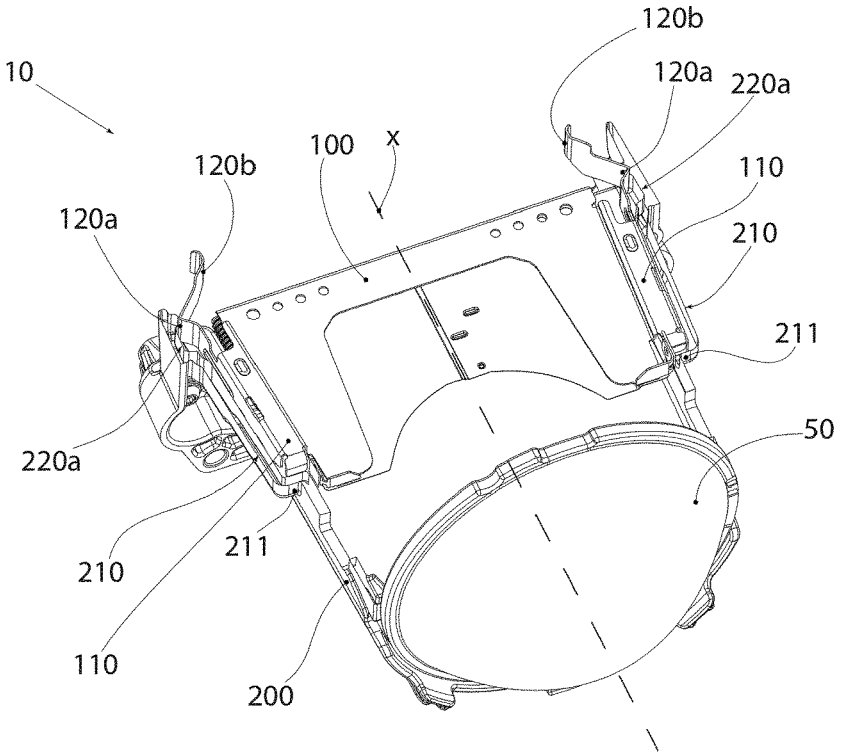
Figure 3:
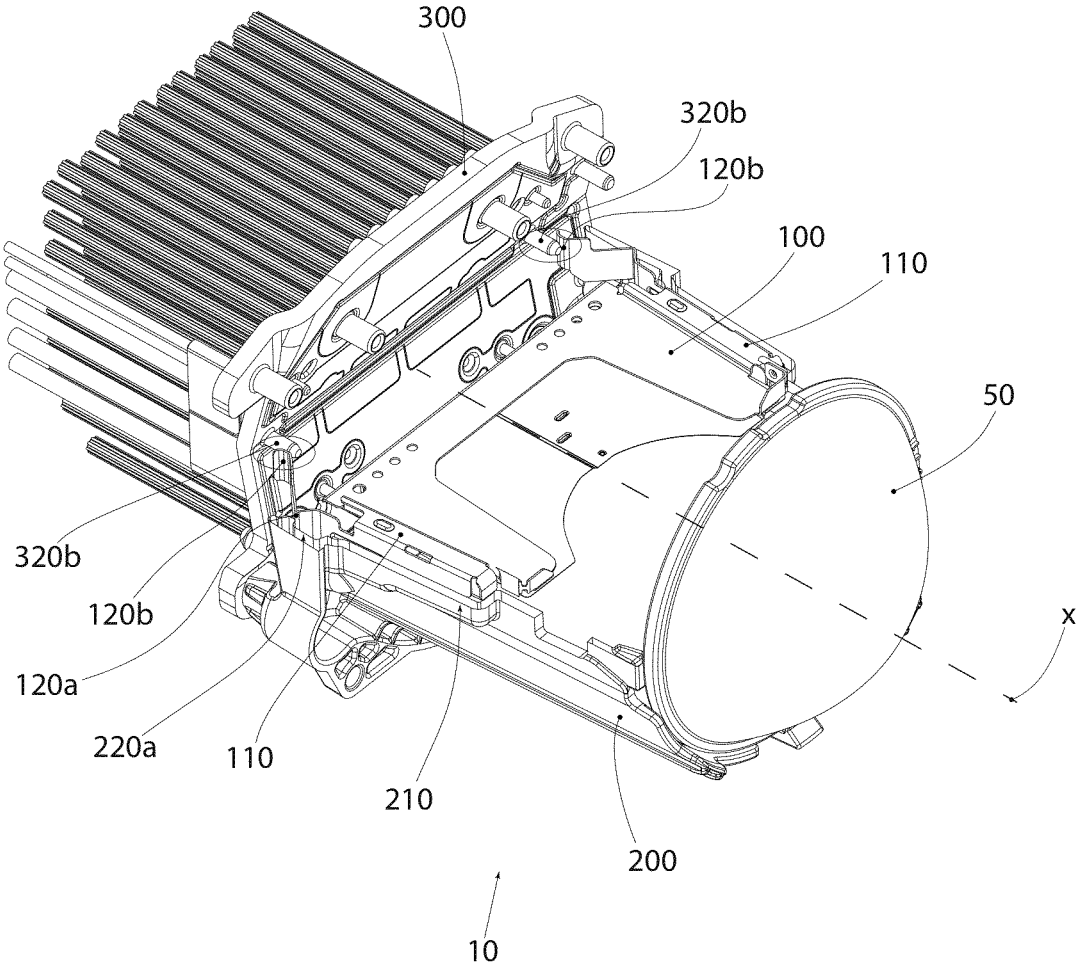

The invention is explained below in more detail based on exemplary drawings. In the drawings, FIG. 1 shows a perspective view of an exemplary projection device having projection optics arranged on a base body and a shield element that can be pushed onto the base body towards an end position, FIG. 2 shows a perspective view of the projection device from FIG. 1, wherein the shield element is in the end position on the base body, FIG. 3 shows a perspective view of the projection device from FIG. 2, wherein a holding element having a second securing element is furthermore provided, which in combination with a first securing element, which is arranged on the shield element, is designed to secure the shield element in its end position.

FIG. 1 shows an exemplary projection device 10 for a motor vehicle headlight, which projection device 10 comprises projection optics 50 to form a light distribution from the light of at least one light source, a shield element 100 and a base body 200, on which the projection optics 50 and the shield element 100 are mechanically connected.

The projection optics 50 can, as shown in the figures, be designed as a projection lens, for instance.

The shield element 100 can be pushed onto the base body 200 along a push-on direction X by means of two guide elements 110, which are arranged on the shield element spaced apart from one another orthogonally to the push-on direction X, onto the base body 200, wherein the guide elements 110 engage in counter-guide elements 210 arranged on the base body 200 and corresponding to the guide elements 110.

The guide elements 110 of the shield element 100 respectively have an end stop 111 at a first end and the counter-guide elements 210, which are designed as recesses or grooves on the base body 200 in the example shown, respectively have a stop 211, which stops 211 are designed in combination with the end stops 111 of the guide elements 210 to limit the movement of the shield element 100 in the direction of the push-on direction X towards an end position. In the end position of the shield element 100, the shield element 100 is arranged in a notional horizontal plane in the projection device 10. The terms "horizontal", "vertical" etc. refer here to a correct installed state of the projection device, for example in a motor vehicle headlight.

FIG. 2 shows the projection device 10 from FIG. 1, wherein the shield element 100 is in an abovementioned end position on the base body 200. The projection device 10 further comprises two clamping devices, which respectively comprise a first and a second clamping element 120*a*, 220*a*, wherein the first clamping element 120*a* is arranged on the shield element 100 and the second clamping element 220*a* is arranged on the base body 200, and wherein the first clamping element 120*a* is designed to engage the second clamping element 220*a*, and wherein the at least one clamping device is designed to clamp the shield element 100 in its end position on the base body 200.

The first clamping elements 120*a* of the shield element 100 are designed here as latching lugs, which respectively engage with the second clamping elements 220*a*, which are designed as recesses or undercuts on the base body 200.

The projection device 10 shown further comprises a holding element 300 and two securing devices, which respectively comprise a first and a second securing element 120*b*, 320*b*, wherein the first securing element 120*b* is designed to engage the second securing element 320*b*, and wherein the at least one securing device is designed to secure the at least one clamping device against disengagement of the clamping elements 120*a*, 220*a*, wherein the first securing element 120*b* is arranged on the shield element 100 and the second securing element 320*b* is arranged on the holding element 300, as can be seen in FIG. 3.

The holding element 300 of the projection optics 50 is attached in this case to the base body 200 opposite along the push-on direction X, wherein the second securing element 320*b* of the holding element 300 is designed as a pin projecting from the holding element 300 in the direction of the push-on direction X.

The first clamping element 120*a* of each clamping device is designed with the first securing element 120*b* of each securing device as an integral, elastic spring tongue, which spring tongue is arranged at the second end opposite the first end of each guide element 110 on the shield element 100 and extends substantially opposite the push-on direction X, wherein the first securing element 120*b* is designed as a lug, and wherein the second securing element 320*b* in engagement with the first securing element 120*b* exerts a force transverse to the push-on direction X on the first securing element 120*b*. As a result of the lug 120*b* being physically or mechanically connected to the first clamping element 120*a*, the first clamping element 120*a* or the latching lug is pushed into the recess 220*a* by the force exerted by the second securing element 320*b*. The force exerted by the second securing element 320*b* is opposite to a release force, which would be required to disengage or release the latching connection of the latching lug 120*a* and the recess 220*a*.

Figure 4:
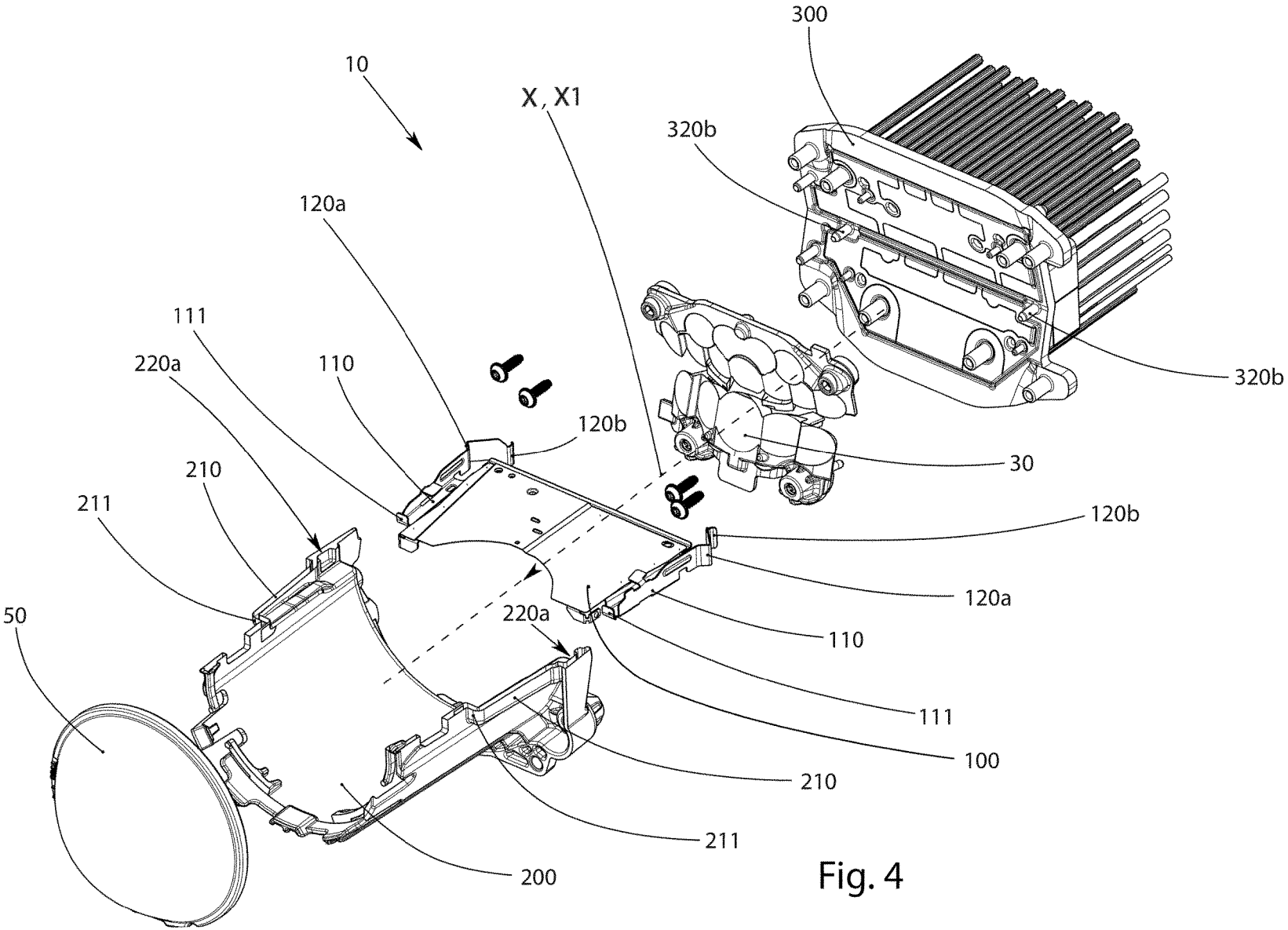

The projection device 10 further comprises at least one or more light sources 30, which are designed to emit light in a main emission direction X1, wherein the push-on direction X is parallel to the main emission direction X1, as is shown in FIG. 4, for example. The holding element 300 is designed here as a heat sink which is assigned to the light sources 30 and is designed to dissipate the heat generated by the light sources 30.

Figure 5:
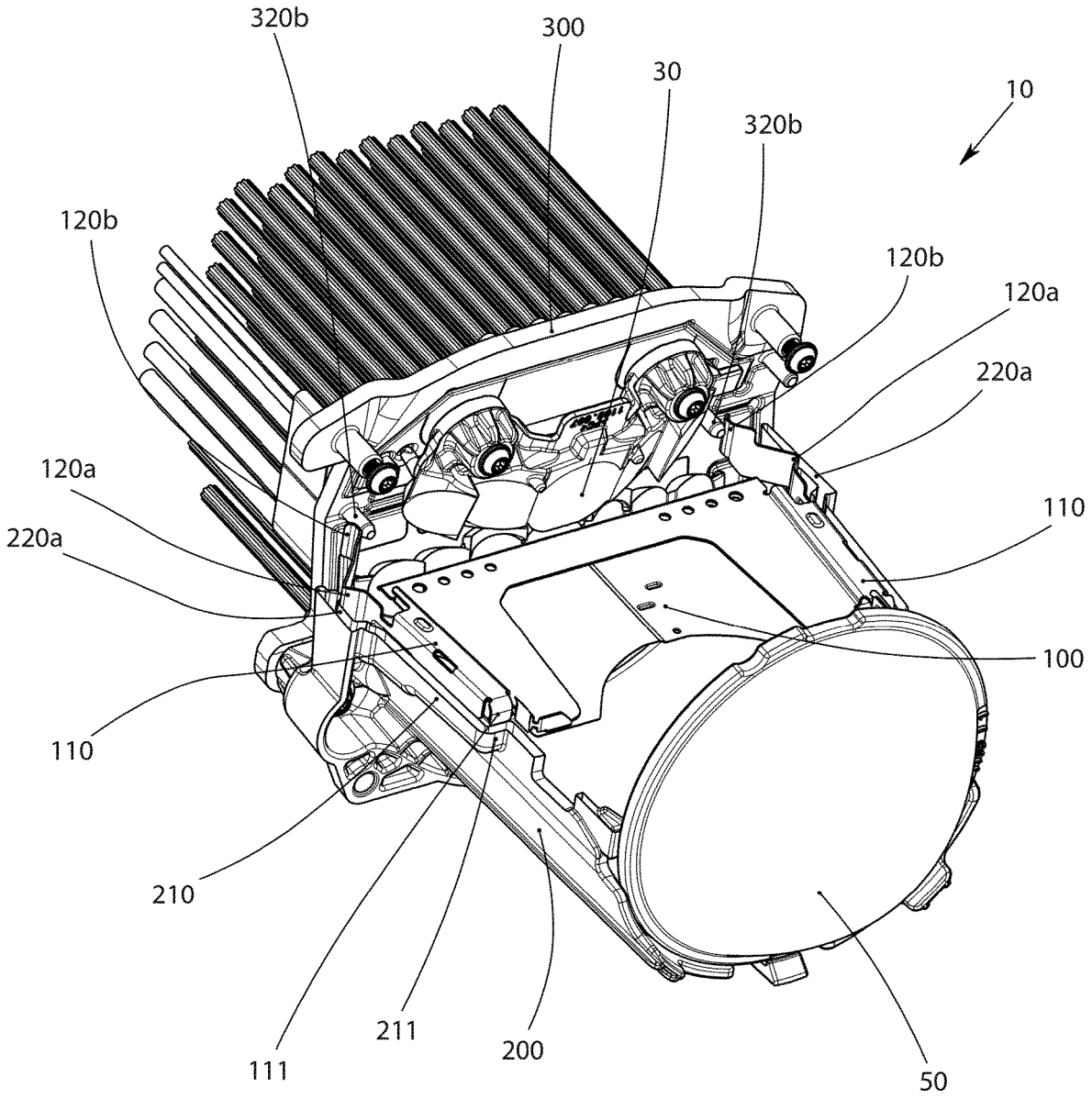

FIG. 5 shows an assembled state of the projection device 10 from FIG. 4.

REFERENCE LIST projection device . . . 10
light source . . . 30
projection optics . . . 50
shield element . . . 100
guide element . . . 110
end stops . . . 111
first clamping element . . . 120*a*
first securing element . . . 120*b*
base body . . . 200
counter-guide element . . . 210
stop . . . 211
second clamping element . . . 220*a*
holding element . . . 300
second securing element . . . 320*b*
push-on direction . . . X
main emission direction . . . X1

The invention claimed is:

1. A projection device (10) for a motor vehicle headlight, the projection device (10) comprising:

projection optics (50) for imaging a light distribution, which is formed from light emitted from at least one light source (30), a shield element (100), a base body (200), wherein the projection optics (50) and the shield element (100) are mechanically connected to the base body (200), wherein the shield element (100) can be pushed onto the base body (200) along a push-on direction (X) by at least two guide elements (110) onto the base body (200), wherein the at least two guide elements (110) engage in counter-guide elements (210) arranged on the base body (200) and corresponding to the at least two guide elements (110), wherein the at least two guide elements (110) of the shield element (100) respectively have an end stop (111) at a first end and the counter-guide elements (210) of the base body (200) respectively have a stop (211), which stops (211) in combination with the end stops (111) of the counter-guide elements (210) are configured to limit the movement of the shield element (100) in the direction of the push-on direction (X) towards an end position, wherein the projection device (10) comprises at least one clamping device, which comprises a first and a second clamping element (120*a*, 220*a*), wherein the first clamping element (120*a*) is arranged on the shield element (100) and the second clamping element (220*a*) is arranged on the base body (200), and wherein the first clamping element (120*a*) is configured to engage the second clamping element (220*a*), and wherein the at least one clamping device is configured to clamp the shield element (100) in a clamping device end position on the base body (200), and wherein the projection device (10) comprises a holding element (300) and at least one securing device, wherein the at least one securing device comprises a first and a second securing element (120*b*, 320*b*), wherein the first securing element (120*b*) is configured to engage the second securing element (320*b*), and wherein the at least one securing device is-configured to secure the at least one clamping device against disengagement of the clamping elements (120*a*, 220*a*), wherein the first securing element (120*b*) is arranged on the shield element (100) and the second securing element (320*b*) is arranged on the holding element (300).

2. The projection device according to claim 1, wherein the holding element (300) of the projection optics is attached to the base body (200) opposite along the push-on direction (X).

3. The projection device according to claim 1, wherein the guide elements (110) of the shield element (100) are arranged on the shield element (100) spaced apart from one another orthogonally to the push-on direction (X).

4. The projection device according to claim 1, wherein at least two clamping devices are provided, wherein a first clamping element (120*a*) is assigned to each guide element (110) of the shield element (100).

5. The projection device according to claim 4, wherein the first clamping element (120*a*) of the clamping devices is respectively arranged at a second end opposite the first end of the guide elements (110).

6. The projection device according to claim 1, wherein the first clamping element (120*a*) is configured as a latching element and the second clamping element (220*b*) is configured as a mating latching element.

7. The projection device according to claim 6, wherein the first clamping element (120*a*) is configured as a latching lug and the second clamping element (220*b*) is configured as an undercut or recess.

8. The projection device according to claim 1, wherein the second securing element (320*b*) of the holding element (300) is configured as a pin projecting from the holding element (300) in the direction of the push-on direction (X).

9. The projection device according to claim 1, wherein the at least one securing device is configured in such a manner that the second securing element (320*b*) in engagement with the first securing element (120*b*) exerts a force transverse to the push-on direction (X) on the first securing element (120*b*).

10. The projection device according to claim 1, wherein the first clamping element (120*a*) of the at least one clamping device is formed with the first securing element (120*b*) of the at least one securing device as an integral, elastic spring tongue.

11. The projection device according to claim 1, wherein the shield element (100) is arranged in a notional horizontal plane in the projection device (10).

12. The projection device according to claim 1, wherein the projection device comprises the at least one light source (30), which is configured to emit light in a main emission direction (X1).

13. The projection device according to claim 12, wherein the push-on direction (X) is parallel to the main emission direction (X1).

14. The projection device according to claim 12, wherein the holding element (300) is configured as a heat sink which is assigned to the at least one light source (30) and is configured to dissipate the heat generated by the at least one light source (30).

15. A motor vehicle headlight having at least one projection device in accordance with claim 1.

16. The projection device according to claim 1, wherein the at least two guide elements (110) consist of exactly two guide elements.

* * * * *